US008771800B2

(12) United States Patent
Beneke et al.

(10) Patent No.: US 8,771,800 B2
(45) Date of Patent: Jul. 8, 2014

(54) METHOD FOR THE LOCAL APPLICATION OF CHEMICAL CONVERSION LAYERS

(75) Inventors: Martin Beneke, Stuhr (DE); Sonja Nixon, Munich (DE); Franz Gammel, Ottobrunn (DE)

(73) Assignee: Airbus Operations GmbH (DE)

( * ) Notice: Subject to any disclaimer, the term of this patent is extended or adjusted under 35 U.S.C. 154(b) by 321 days.

(21) Appl. No.: 12/849,334

(22) Filed: Aug. 3, 2010

(65) Prior Publication Data

US 2011/0033629 A1 Feb. 10, 2011

Related U.S. Application Data

(60) Provisional application No. 61/231,079, filed on Aug. 4, 2009.

(30) Foreign Application Priority Data

Aug. 4, 2009 (DE) ..... 10 2009 036 102

(51) Int. Cl.
*B05D 1/28* (2006.01)

(52) U.S. Cl.
USPC ..... 427/429

(58) Field of Classification Search
USPC ..... 427/429
See application file for complete search history.

(56) References Cited

U.S. PATENT DOCUMENTS

| | | | | | |
|---|---|---|---|---|---|
| 3,201,212 | A | * | 8/1965 | Zaremski | 428/628 |
| 5,702,759 | A | | 12/1997 | White et al. | |
| 5,891,521 | A | * | 4/1999 | Marumoto et al. | 427/282 |
| 5,989,682 | A | * | 11/1999 | Anderson | 428/152 |
| 6,010,263 | A | | 1/2000 | White et al. | |
| 6,048,921 | A | * | 4/2000 | White et al. | 524/462 |

FOREIGN PATENT DOCUMENTS

| | | | |
|---|---|---|---|
| CH | 189417 | A | 2/1937 |
| DE | 544371 | C | 2/1932 |
| DE | 556767 | C | 8/1932 |
| DE | 19638176 | A1 | 4/1998 |
| DE | 10020808 | A1 | 1/2001 |
| GB | 377923 | A | 8/1932 |
| WO | 2007/134152 | A1 | 11/2007 |

* cited by examiner

*Primary Examiner* — Nathan Empie
(74) *Attorney, Agent, or Firm* — Lerner, David, Littenberg, Krumholz & Mentlik, LLP

(57) ABSTRACT

The present invention relates to a method for producing a chemical conversion layer on a metal surface, comprising the following method steps: (i) providing at least one cloth having a defined area, which is resistant at least in the pH range from 2 to 7 and is tear-proof in the wet state, (ii) bringing the cloth into contact with a liquid, which contains at least one active component for the formation of the chemical conversion layer, so that the cloth is impregnated with the liquid, (iii), applying the cloth impregnated with the liquid to a metal surface, and (iv) removing the cloth from the metal surface at a moment at which the cloth is still at least damp.

12 Claims, No Drawings

METHOD FOR THE LOCAL APPLICATION OF CHEMICAL CONVERSION LAYERS

CROSS-REFERENCE TO RELATED APPLICATIONS

This application claims the benefit of the filing date of U.S. Provisional Patent Application No. 61/231,079 filed Aug. 4, 2009, the disclosure of which is hereby incorporated herein by reference.

The present invention relates to a method for the formation of a chemical conversion layer and a cloth which can be used in this method.

In order to protect metals, such as aluminum, from corrosion, there are various possibilities which are generally known to a person skilled in the art. In this context, for example, the deposition of metal coatings ("galvanizing", etc.), anodic oxidation, the formation of chemical conversion layers (for example, chromating, phosphating), or the application of paints or lacquers, typically additionally after the formation of a chemical conversion layer, may be listed as examples.

In particular for aluminum or aluminum alloys, chemically produced passivations of the metal surface (i.e., conversion layers) are of special significance for corrosion protection, in addition to the anodically produced oxide layers. Chemical conversion layers may also be formed on other common metal surfaces.

Chromate conversion layers are typically generated in solutions containing chromium(VI). These chromium(VI) compounds represent a significant health risk, however. In the meantime, however, methods have also become known, using which chromium(III)-based conversion layers may be produced, which are free of chromium(VI). Such methods for producing chromium(VI)-free conversion layers are described, for example, in DE 196 38 176 A1 and WO 2007/134152 A1.

Applying compositions for the formation of a chemical conversion layer in the immersion, spraying, or wiping method on the metal surface to be treated is known. Applying such compositions to the metal surface via a pen-shaped application element, which contains a felt, is also known. These pen-shaped application devices are described in U.S. Pat. No. 5,702,759 and U.S. Pat. No. 6,010,263.

An application in the bath method cannot be performed for retrofitting, repair, or small-area of processing of larger structures.

Local applications by spraying, brushes, or pen application (pen-shaped application element) are difficult to monitor.

The dosing of the electrolyte by brushes proves to be difficult. In particular on inclined surfaces, the running off of the electrolytes results in an uneven liquid film. Aerosols are released by spraying, which are harmful (e.g., fluorides). For both methods, extensive precautions must be taken in order to collect excessive electrolyte quantities which drip off and dispose of them as prescribed. The application of the pen is restricted to small areas. Because of the colorless electrolyte, it is difficult to monitor in all of these methods whether all surfaces to be processed are sufficiently wetted with liquid.

It is therefore an object of the present invention to provide a method for producing a chemical conversion layer, which avoids the above-described disadvantages as much as possible and nonetheless produces a conversion layer having high corrosion resistance.

This object is achieved by the provision of a method for producing a chemical conversion layer on a metal surface, which comprises the following method steps:

(i) Providing a cloth having a defined area, which is resistant at least in the pH range from 2 to 7 and is tear-proof in the wet state, (ii) bringing the cloth into contact with a liquid, which contains at least one active component for the formation of the chemical conversion layer, so that the cloth is impregnated with the liquid, (iii) applying the cloth impregnated with a liquid to a metal surface, and (iv) removing the cloth from the metal surface at a moment in which the cloth is at least still damp.

Through the application of one or more cloths which are impregnated with the liquid, which contains an active component for the formation of a chemical conversion layer (such a liquid is also referred to as an electrolyte), a small-area treatment and also a large-area treatment are possible. Overdosing is not possible due to the neutralization. The cloths do not permit the electrolyte to run off and may be disposed of as special waste after completed treatment. The method according to the invention ensures that a quantity of liquid sufficient for the conversion reaction is available on the component surface. Through the coverage of the entire metal area to be processed using the cloth or the cloths, it is readily possible to prevent a specific surface area from unintentionally remaining untreated.

The term "chemical conversion layer" is used in the context of the present invention in its typical meaning, i.e., it relates to a metal passivation layer, which was produced by chemical reaction between the metal surface and an electrolyte applied to the metal surface.

The conversion layer produced in the method according to the invention is preferably a chromium(III)-based layer.

However, other chemical conversion layers may also be formed using the method according to the invention, such as a phosphate conversion layer by phosphating or a conversion layer based on zirconate.

The chromium(III)-based conversion layer produced using the method according to the invention is preferably free of chromium(VI).

The conversion layer obtained using the method according to the invention preferably has a corrosion resistance of greater than 72 hours, more preferably greater than 168 hours, in the salt spray test according to ASTM B117.

Using the method according to the invention, the layer thickness of the produced conversion layer can be varied in a broad range and is preferably in the range from 50 nm to 500 nm, more preferably 80 nm to 150 nm.

Using the method according to the invention, chemical conversion layers may be produced on various metals. The method according to the invention is preferably used for aluminum, zinc, magnesium, or alloys of these metals.

In a particularly preferred embodiment, the metal is aluminum alloys used in aircraft construction, in particular from the classes AA2xxx, AA7xxx, AA6xxx, AlLi, and AlMgSc.

As mentioned above, the method according to the invention comprises the provision of at least one cloth having a defined area, which is resistant at least in the pH range 2-7 and is tear-proof in the wet state, in a step (i).

In the context of the present invention, the term "cloth" is used in its typical meaning and therefore relates in particular to textile fabric made of thread and/or fibers.

Depending on the type and size of the metal surface to be treated, one cloth or alternatively multiple cloths may be used. If one cloth is used, its area or shape is to be selected so that it corresponds to the shape of the metal surface to be processed. If multiple cloths are used, their shape can be selected so that the metal surface to be processed may be covered as effectively as possible.

A cloth which is resistant in the pH range 2-7 and is tear-proof in the wet state is obtained by the selection of suitable fiber or thread materials.

The cloth is preferably manufactured from natural or artificial fibers and their mixtures. The fibers are preferably selected from cellulose, polyester, nylon, polypropylene, polyamide, polyvinyl alcohol, or polyurethane fibers, or their mixtures, in particular tissue reinforced using polypropylene. The fibers may also be provided as thread.

The textile fabric of the cloth can be knitted or woven in a typical manner. It can also be a knitted or woven mixed fabric.

Alternatively, the cloth can also be provided as a nonwoven or fiber nonwoven having sufficient absorbency, preferably having an absorbency of at least 275 $g/m^2$.

In the case of nonwoven cloths, they preferably have a weight per unit area of at least 68 $g/m^2$ and/or an absorbency of at least 275 $g/m^2$.

As already mentioned above, the method according to the invention can be used for the formation of small-area and also large-area conversion layers, because the cloths to be used may be readily adapted to the metal surface to be processed.

The area of the cloths can therefore be varied in a broad range. Above all, the largest possible and as few as possible individual parts are to be used.

Suitable cloths which have the above-described properties are commercially available. For example, Kimberley Clark Wypall X60 6036 is noted here.

As stated above, in step (ii) of the method according to the invention, the cloth is brought into contact with a liquid, which contains at least one active component for the formation of the chemical conversion layer, so that the cloth is impregnated with the liquid.

Such a liquid, which contains at least one active component for the formation of the chemical conversion layer, is typically referred to as an electrolyte.

The term "electrolyte" is to be understood broadly in the context of the present invention and relates to materials and/or compositions which are at least partially provided as ions and/or contain ions.

Suitable electrolytes for the formation of a chemical conversion layer are known to a person skilled in the art. Depending on the desired type of the conversion layer, it is known to the person skilled in the art which electrolytes fundamentally come into consideration.

Preferably, the liquid in step (ii) contains at least one chromium(III) compound, more preferably at least one chromium (III) complex. The liquid is still more preferably free of chromium(VI) compounds. This allows the formation of a chemical conversion layer which is free of chromium(VI).

The ligands of the chromium(III) complex are preferably selected from the group comprising: chelate ligands, such as dicarboxylic acids, tricarboxylic acids, hydroxy carboxylic acids, in particular oxalic, malonic, succinic, glutaric, adipic, pimelic, suberic, azelaic, sebacic acid; maleic acid, phthalic acid, terephthalic acid, tartaric acid, citric acid, malic acid, ascorbic acid; acetyl acetone, urea, urea derivatives; complex ligands, in which the complexing functional group contains nitrogen, phosphorus, or sulfur, in particular —$NR_2$ and/or —$PR_2$, R being an organic, in particular aliphatic residue and/or H, independently of one another, and/or —SR, R being an organic, in particular aliphatic residue or H; phosphinates and phosphinate derivatives; or their mixtures.

The liquid preferably has a pH value less than 7.0, more preferably a pH value between 3.0 and 4.2 in step (ii).

In a further preferred embodiment, the liquid in step (ii) can contain fluorometallate anions, preferably selected from fluorosilicate, fluorotitanate, or fluorozirconate anions or their mixtures, and at least one water-soluble chromium(III) compound, preferably chromium(III) fluoride.

Electrolytes based on chromium(III) for the formation of chromate conversion layers free of chromium(VI) are known per se to a person skilled in the art. In this context, reference can be made, for example, to DE 196 38 176 A1 and WO 2007/134152, which disclose suitable compositions for the formation of chromium(III)-based conversion layers.

For example, SurTec® 650 RTU or ChromitAL® TCP ready-to-use solution, sold by Surtec GmbH, can be listed as a preferred liquid in the context of the present invention. As further exemplary commercially available liquids having an active component for the formation of a chemical conversion layer (i.e., electrolytes) Henkel Alodine 5923, Henkel Alodine 871 Metalast TCP-HF, and Mac Dermid Interlox 338 in the concentrations suggested by the producers can be listed.

The bringing into contact in step (ii) preferably occurs in that the cloth is immersed in a bath which contains the liquid containing the active component until complete saturation of the cloth.

The bringing into contact in step (ii) can also be performed in that the cloth is sprayed with the liquid.

In step (iii) of the method according to the invention, the application of the cloth impregnated with the liquid to a metal surface is performed.

The cloth impregnated with the electrolyte is preferably applied to a metal surface to be treated when it is just no longer dripping wet.

As already discussed above, the metal is preferably aluminum, zinc, magnesium, or alloys of these metals. It is particularly preferably aluminum or an aluminum alloy.

Upon application of the cloth, it is preferable that no wrinkles or bubbles arise, so that complete wetting of the metal surface is ensured. If necessary, the cloth can be fixed by suitable aids such as straps and/or support forms.

A cloth in the size of the surface to be treated is preferably applied. If multiple cloths are applied, they are preferably to be laid abutting or overlapping. Upon overlap of the cloths, it is preferably to be ensured that wetting of the surface also occurs in the overlap area, e.g., by pressing against the cloth in this area.

If multiple cloths are used, the simultaneous treatment is preferred, because this thus prevents the surface from being treated twice or not at all.

The surface is preferably subjected to a pretreatment and cleaning before the application of the cloth or cloths, such as a mechanical treatment (grinding, blasting) or a chemical treatment (pickling). Suitable pretreatment methods are known to a person skilled in the art.

As described above, the cloth is removed from the metal surface in step (iv) at a moment in which the cloth is still damp, i.e., it has not yet completely discharged the liquid absorbed in step (ii).

The cloth is preferably removed in step (iv) at earliest 2 minutes, still more preferably at earliest 3 minutes after the application on the metal surface in step (iii).

In a preferred embodiment, the cloth is removed from the metal surface in step (iv) after 2 to 10 minutes, still more preferably after 3 to 8 minutes after the application in step (iii).

In a preferred embodiment of the method according to the invention, the metal surface is cleaned with water after the removal of the cloth in a further method step (v). This can be performed by spraying, or in a preferred embodiment via wiping using a cloth impregnated in water. The goal is the complete removal of residual salts on the surface.

According to a further aspect, the present invention provides a cloth for the formation of a chemical conversion layer, which is resistant in the pH range from 2 to 7 and is tear-proof in the wet state and has an adsorbed liquid, which contains an active component for the formation of a conversion layer.

The cloth preferably has a defined area, which is already adapted to the metal surface to be treated.

The cloth is preferably manufactured from natural or artificial fibers and their mixtures. The fibers are preferably selected from cellulose, polyester, nylon, polypropylene, polyamide, polyvinyl alcohol, or polyurethane fibers, or their mixtures, in particular tissue reinforced using polypropylene.

The fibers may also be provided as thread.

Reference can be made to the above statements with respect to the preferred properties of the cloth and the liquid which is adsorbed in the cloth.

The textile fabric of the cloth can be knitted or woven in a typical manner. It can also be a knitted or woven mixed fabric. Alternatively, the cloth can also be provided as a nonwoven or fiber nonwoven.

In the case of nonwoven cloths, they preferably have a weight per unit area of at least 68 $g/m^2$ and/or an absorbency of at least 275 $g/m^2$.

As already mentioned above, the method according to the invention can be used for the formation of small-area and also large-area conversion layers, because the cloths to be used may be readily adapted to the metal surface to be processed.

According to a further aspect, the present invention relates to the use of the above-defined cloth for the formation of a chemical conversion layer on a metal surface.

Reference can be made to the above statements with respect to the preferred features of the cloth, the chemical conversion layer, and the metal to be treated.

The invention is explained in greater detail by the following examples.

EXAMPLES

In the context of the examples, the surface of the following metal alloy was treated: A2024 unclad. Dimensions of the treated surface: 150×80 mm.

ChromitAl 650 RTU was used as the electrolyte.

Wypall X60 6036 was used as the cloth. The cloth had dimensions of 200×100 mm. In the examples, one cloth at a time was applied to the metal surface to be treated.

In example 1, the cloth impregnated with the electrolyte was left on the metal surface for a duration of 2 minutes. In example 2, the duration was 4 minutes, and an example 3 the duration was 30 minutes. In the examples 1 and 2, the cloth was still damp at the moment of removal from the metal surface, while it had already dried out in example 3.

The metal surfaces having chemical conversion layer obtained in examples 1-3 were subjected to a lacquer adhesion test according to EN ISO 2409 Gt 0 and a salt spray test according to ASTM B117.

The conversion layers obtained in examples 1 and 2 resulted in a corrosion resistance of at least 72 hours.

The conversion layers obtained in examples 1 and 2 resulted in very good results in the lacquer adhesion test.

In the case of the conversion layer obtained in example 3, the lacquer adhesion test displayed inadequate adhesion with Gt 5. Bubbling occurred during the water storage.

Moreover, it is to be noted that "comprising" does not exclude other elements or steps and "a" or "an" does not exclude multiples. Furthermore, it is to be noted that features or steps which have been described with reference to one of the above exemplary embodiments may also be used in combination with other features or steps of other above-described exemplary embodiments. Reference numerals in the claims are not to be viewed as a restriction.

The invention claimed is:

1. A method for producing a chemical conversion layer on a metal surface, comprising:

(i) providing at least one cloth having a defined surface, said cloth being resistant at least in the pH range of 2 to 7 and being tear-proof in the wet state, wherein the cloth is manufactured from fibers selected from the group consisting of cellulose, polyester, nylon, polypropylene, polyamide, polyvinyl alcohol, polyurethane fibers, and mixtures thereof, wherein a size of the at least one cloth is generally equal to the size of the metal surface to be treated;

(ii) bringing the cloth into contact with a liquid containing at least one active component for the formation of the chemical conversion layer, so that the cloth is impregnated with the liquid, (iii) applying the cloth impregnated with the liquid to a metal surface, wherein the cloth is laid on the metal surface and is left stationary thereon; and (iv) removing the damp cloth from the metal surface, wherein the cloth is removed in step (iv) at earliest after 2 minutes after the application to the metal surface in step (iii).

2. The method according to claim 1, wherein the conversion layer is a chromium(III)-based conversion layer.

3. The method according to claim 2, wherein the conversion layer containing chromium(III) is free of chromium(VI).

4. The method according to claim 1, wherein the conversion layer has a corrosion resistance of greater than 72 hours in the salt spray test according to ASTM B117.

5. The method according to claim 1, wherein the metal is selected from the group consisting of aluminum, zinc, magnesium, and alloys of these metals.

6. The method according to claim 1, wherein the cloth comprises a tissue reinforced using polypropylene.

7. The method according to claim 1, wherein the liquid in step (ii) contains at least one chromium(III) compound.

8. The method according to claim 1, wherein the bringing into contact in step (ii) is performed such that at least one of immersing the cloth in a bath containing the liquid containing the at least one active component, and spraying the cloth with the liquid containing the at least one active component occurs.

9. The method according to claim 1, wherein, in a further method step (v), the treated metal surface is wiped with water after the removal of the cloth.

10. The method of claim 1, further comprising affixing the cloth to the metal surface.

11. The method of claim 1, wherein the at least one cloth comprises a plurality of cloths laid abutting or overlapping one another on the metal surface.

12. The method of claim 11, further comprising pressing in the area of the overlap of at least two of the plurality of cloths.

* * * * *